US005586767A

United States Patent [19]

Bohland

[11] Patent Number: 5,586,767

[45] Date of Patent: Dec. 24, 1996

[54] LAWN GAME APPARATUS FOR USE WITH A WATER HOSE

[76] Inventor: William Bohland, 101 N. 72nd Ave., Pensecola, Fla. 32506

[21] Appl. No.: 619,006

[22] Filed: Mar. 21, 1996

[51] Int. Cl.[6] ..... A63B 67/00

[52] U.S. Cl. ..... 273/349

[58] Field of Search ..... 273/349, 350, 273/384

[56] References Cited

U.S. PATENT DOCUMENTS

| | | | |
|---|---|---|---|
| 2,752,156 | 6/1956 | Washburn | 273/349 |
| 3,434,716 | 3/1969 | Schwartz | 273/349 X |
| 3,592,468 | 7/1971 | Simendinger, Jr. | 273/350 X |
| 3,843,127 | 10/1974 | Lack | 273/349 |
| 4,077,629 | 3/1978 | Chestney | 273/349 |
| 4,909,518 | 3/1990 | Erlandson | 273/357 |

*Primary Examiner*—William H. Grieb
*Attorney, Agent, or Firm*—George R. McGuire

[57] ABSTRACT

The present invention provides game apparatus intended to be played on a lawn by two teams comprised of one or two participants each. Each teams' participants stand within a boundary defined by a hoop positioned adjacent a respective framework. The two teams are spaced in facing relation to one another, a predetermined distance apart, and each participant has several projectiles to toss towards the opposing framework. The framework is comprised of a series of hollow, PVC pipes arranged to form a hose receiving base portion and a water emitting T-portion extending vertically upward from the base portion, wherein the ends of the horizontal cross member of the T include spray nozzles attached thereto. An arm is pivotally attached at its proximal end to the vertical member of the T-portion, and includes a bucket securely attached to its distal end. The arm controls a valve positioned inside the vertical member. In its rested position, the arm extends horizontally outward from the vertical member, with the valve being in a closed position. As the arm is pivoted downwardly by weighted projectiles tossed into the basket by the teams, the valve opens a corresponding amount. When the arm is forced to an essentially vertical position, the valve is completely open.

13 Claims, 4 Drawing Sheets

36
56
50
36
54
34
32
30
36
33
33
33
52
38
36
36
38
36
44
36
36
36
44
36
48
38
36
40
36
42
38

LAWN GAME APPARATUS FOR USE WITH A WATER HOSE

BACKGROUND OF THE INVENTION

The present invention generally relates to games typically played on a lawn, and more particularly, to a lawn game involving the use of a garden hose, wherein the losing player(s) get sprayed with water.

During the summer months, when temperatures are high, children generally like to play games which are fun and will keep them cool. For those children who don't have access to a swimming pool, a garden hose and sprinkler are typical items used to get relief from the heat. However, spraying oneself off with a hose, or running through a sprinkler does not provide an enjoyable activity for the children.

Thus, games played in, with or near water have been developed to offer people an enjoyable activity that will provide relief from the hot weather. U.S. Pat. Nos. 3,592,468 to Simendinger, Jr., U.S. Pat. No. 3,434,716 to Schwartz, U.S. Pat. No. 4,077,629 to Chestney, 4,909,518 to Erlandson et al., and U.S. Pat. No. 2,752,156 to Washburn provide examples of such games. However, the '468, '716, and '629 patents disclose games requiring a swimming pool or natural body of water. Therefore, people without access to such things will not be able to play the games described in those patents. The '518 patent discloses a fairly complex game involving large receptacles for holding the participants who launch water balloons at one another. Finally, the '156 patent involves a sprinkler system, but requires very little user interaction as the garden hose and sprinkler provide the game playing action.

Accordingly, it is a principal object of the present invention to provide a competitive lawn game wherein the losing participant(s) are automatically sprayed by water.

It is a further object of the present invention to provide a lawn game which is easy to set up or take down.

It is another object of the present invention to provide a lawn game where the outcome is determined by the skill of the participants, as opposed to luck or chance.

It is yet an additional object of the present invention to provide a lawn game which is easy and inexpensive to manufacture.

Other objects and advantages of the present invention will in part be obvious, and in part appear hereinafter.

SUMMARY OF THE INVENTION

In accordance with the foregoing objects and advantages, the present invention provides game apparatus intended to be played on a lawn by two teams comprised of one or two participants each. Each teams' participants stand within a boundary defined by a hoop positioned adjacent a respective framework. The two teams are spaced in facing relation to one another, a predetermined distance apart, and each participant has several projectiles to toss towards the opposing framework.

The framework is comprised of a series of hollow, PVC pipes arranged to form a base portion and a T-portion extending vertically upward from the base portion, wherein the ends of the horizontal cross member of the T include spray nozzles attached thereto. An arm is pivotally attached at its proximal end to the vertical member of the T-portion, and includes a bucket securely attached to its distal end. The arm controls a valve positioned inside the vertical member. In its rested position, the arm extends horizontally outward from the vertical member, with the valve being in a closed position. As the arm is pivoted downwardly by weighted projectiles tossed into the basket, the valve opens a corresponding amount. When the arm is forced to an essentially vertical position, the valve is completely open.

The base of the framework is adapted to receive the end of a garden hose. When the garden hose is turned on, water flows into and through the framework. When closed, the valve positioned in the vertical member of the T-portion prohibits any water from escaping. However, as the valve progressively opens, a corresponding amount of water is allowed to pass therethrough, and eventually out through the nozzles positioned on the cross member's ends. Accordingly, the participants standing in the hoops adjacent the framework, are sprayed by the exiting water.

The participants each have a plurality of weighted projectiles (i.e., balls, beanbags, etc.). It is the goal of the game to toss the projectiles into the basket attached to the opposing framework. As each projectile is made into the basket, the arm is pivoted downwardly a slight amount, thereby opening the valve a corresponding amount. The arm requires several projectiles to be made into the basket before it is fully pivoted, thereby fully opening the valve. As more projectiles are made, more water will be emitted from the framework, thereby spraying the opposing participants.

BRIEF DESCRIPTION OF THE DRAWINGS

The foregoing and other features of the invention will be more readily understood and fully appreciated from the following Detailed Description, taken in conjunction with the accompanying drawings, wherein.

DETAILED DESCRIPTION

Figure 1:
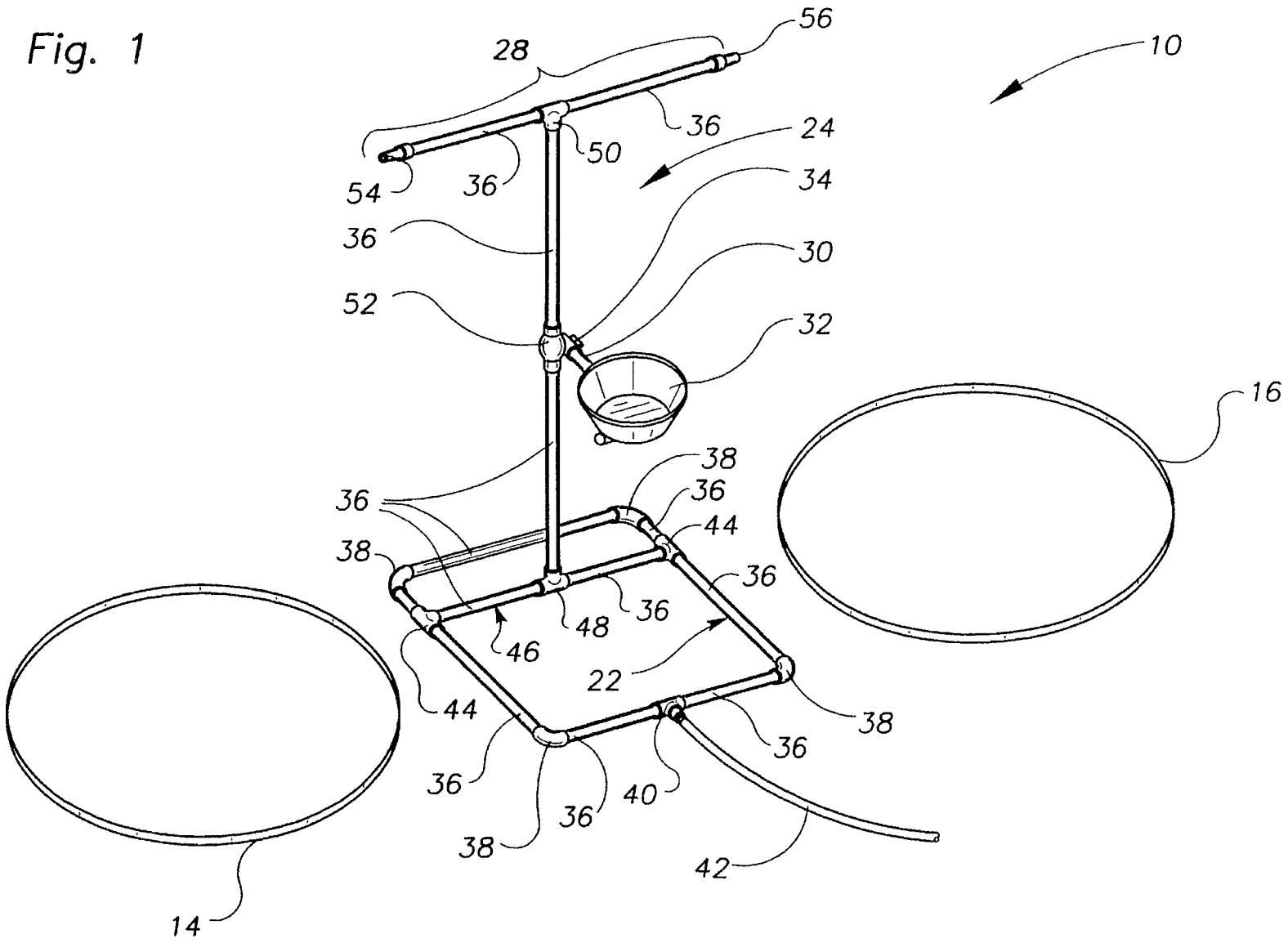
FIG. 1 is a perspective view showing a single team's playing station.
Figure 6:
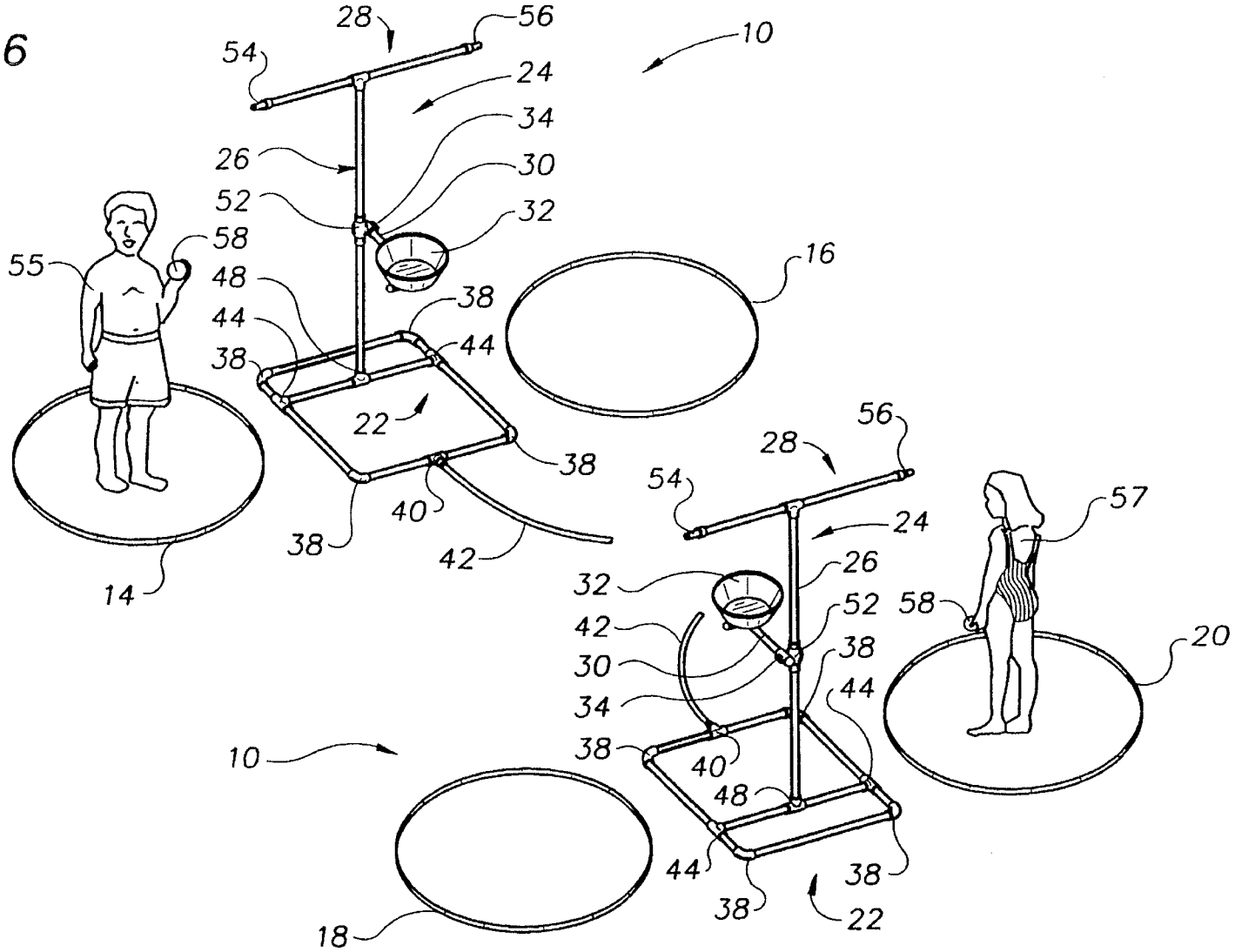
FIG. 6 is a perspective view illustrating how the present invention is intended to be set up and played.

Referring now to the drawing figures, wherein like reference numerals refer to like parts throughout, there is seen in FIG. 1 a single team's playing station, denoted generally by reference numeral 10. Playing station 10 is basically comprised of a water conveying framework, denoted generally 12, and two hoops 14 and 16 lying on the ground, adjacent the sides of framework 12. As seen in FIG. 6, the game is intended to be played by two teams each comprised of one or two participants. Each participant stands within the periphery of one of the hoops 14, 16 for one team, and 18, 20 for the other team.

Figure 3:
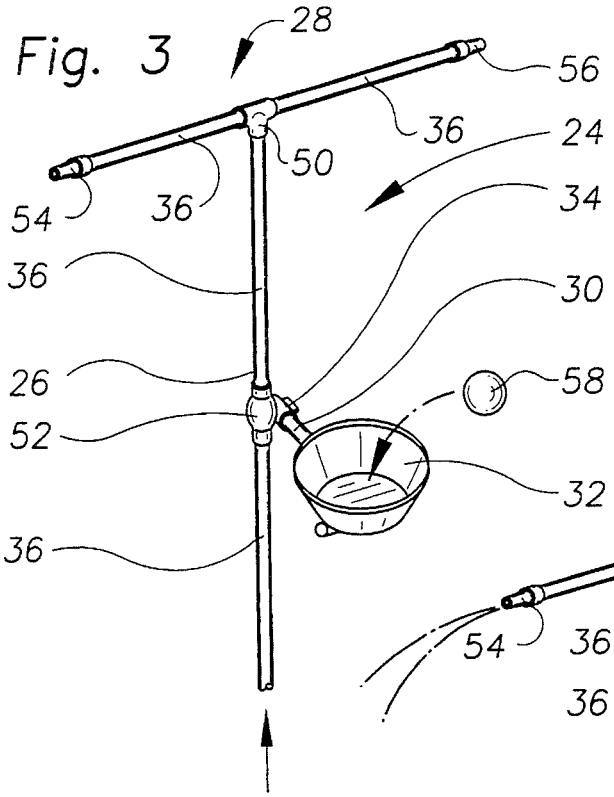
FIG. 3 is a partial perspective view of the present invention showing the arm in an unpivoted position.
Figure 4:
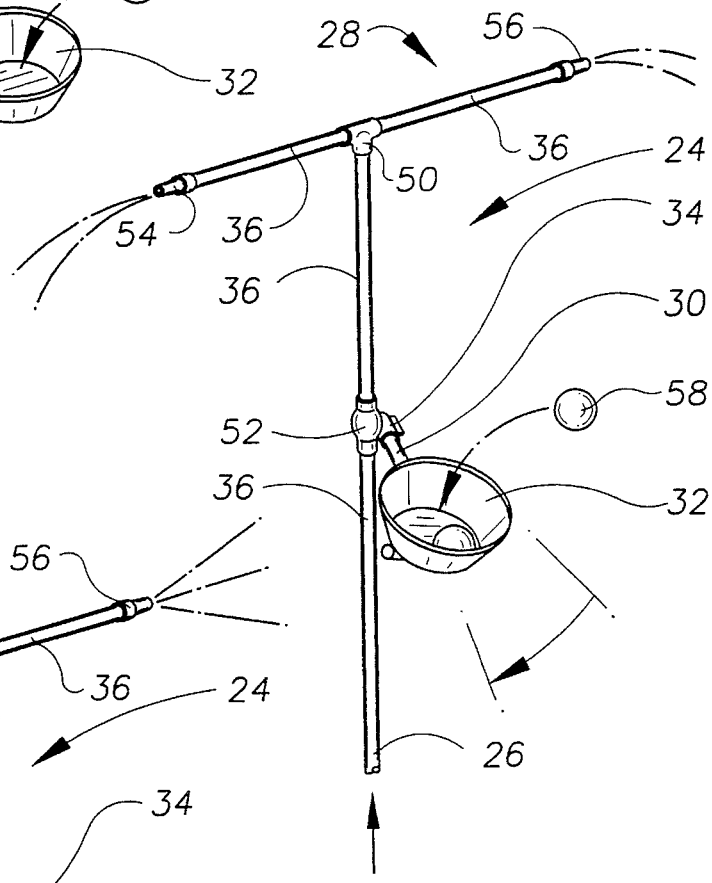
FIG. 4 is a partial perspective view of the present invention showing the arm in a partially pivoted position'
Figure 5:
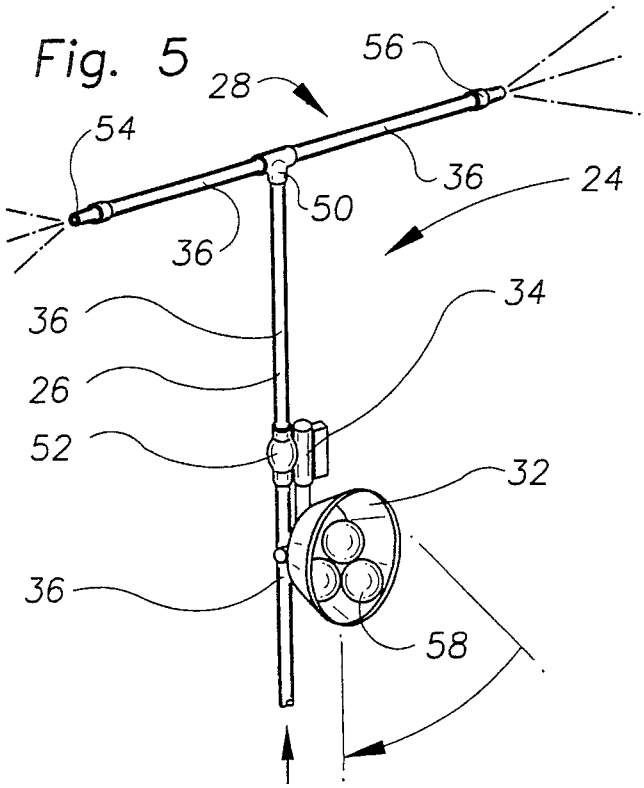
FIG. 5 is a partial perspective view of the present invention showing the arm in a fully pivoted position.

Framework 12 is generally comprised of a plurality of interconnected, polyvinyl chloride (PVC) pipes. The pipes are arranged to form a stable base portion 22, and a water transmitting and emitting portion 24 extending vertically upward from base portion 22. Portion 24 includes a vertical section 26 and a cross member 28 which extends horizontally in vertically spaced relation above base 22. An arm 30 is pivotally connected at its proximal end to vertical section 26, at an intermediate position thereof, and includes a bucket 32 securely attached to its distal end by a set of tees 33. Arm 30 extends perpendicularly outward from vertical section 26 when in its unpivoted, neutral position, and its pivotal motionability controls the positioning of a valve 34 (FIG. 2) operatively positioned within vertical section 26. When arm 30 is in its unpivoted position, valve 34 is completely closed, and as it pivots downwardly, valve 34 opens a corresponding amount until arm 30 reaches its terminal downward position which opens valve 34 its maximum amount, as illustrated in FIGS. 3–5.

Figure 2:
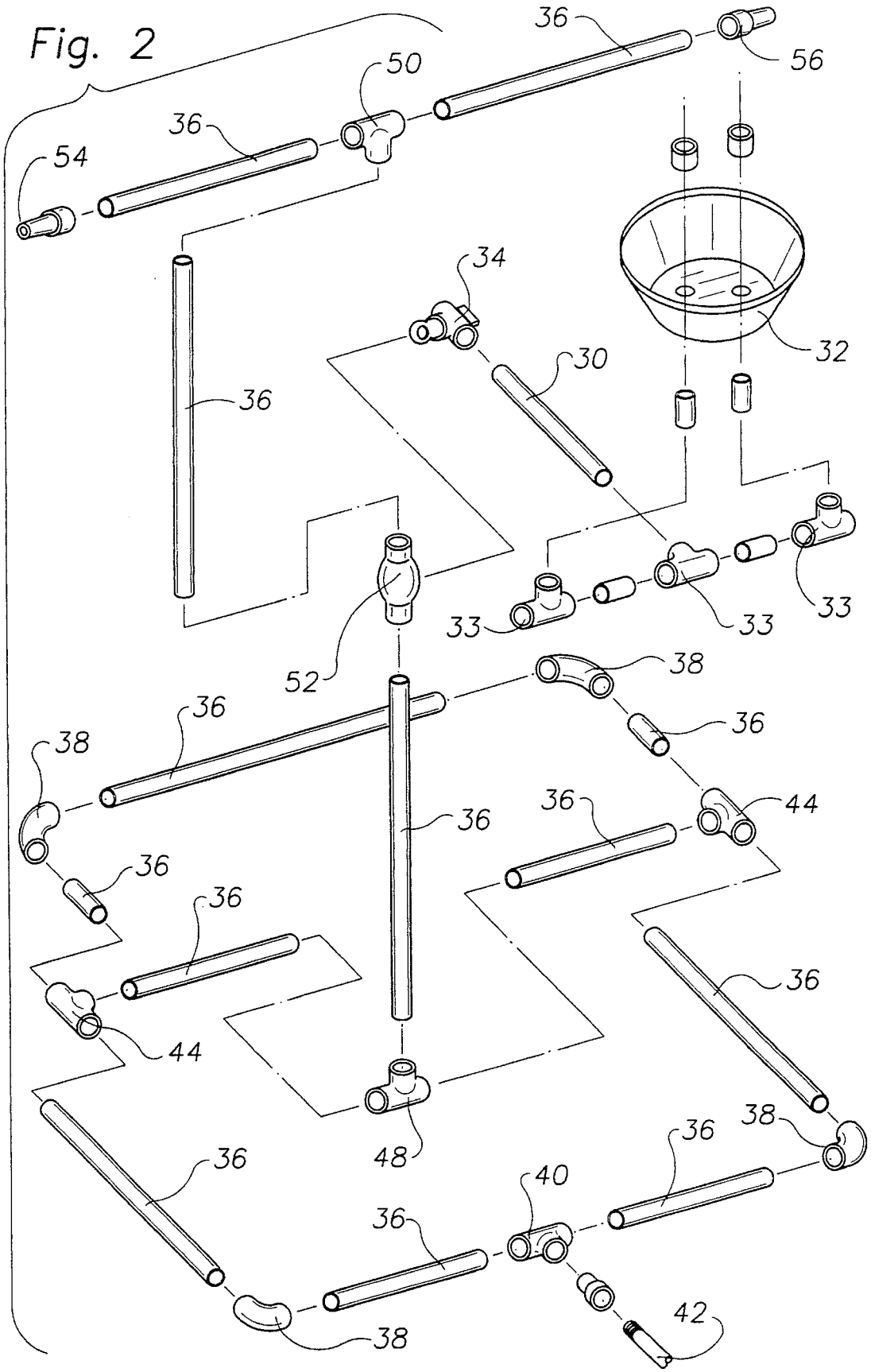
FIG. 2 is an exploded view of the present invention's framework.

Referring now to FIG. 2, base portion 22 is seen to be comprised of a plurality of PVC pipes 36 interconnected by elbows 38 and tees. Elbows 38 are positioned at the four corners of base 22 to dictate the rectangular shape of base 22, and a first tee 40 is positioned along the front row of pipes 36 to cooperatively receive a hose 42. Other tees 44 are appropriately positioned to form an intermediate reinforcing row of pipe 46, and form a juncture 48 from which water transmitting and emitting portion 24 can extend.

Water transmitting and emitting portion 24 is comprised of PVC piping 36 extending vertically upward from intermediate reinforcing row 46 present on base 22 (this is vertical section 26), and a horizontally extending set of pipe 36 (cross-member 28) connected to vertical section 26 by a tee 50. Piping 36 of vertical section 26 includes a valve housing connector 52 disposed at an intermediate position therealong. Connector 52 frictionally holds valve 34 therein, thereby permitting valve 34 to remain positioned in a predetermined position absent exterior forces. Cross-member 28 includes spray nozzles 54 and 56 connected to its terminal ends for emitting water therefrom.

To play the game, two playing stations 10 are set up in spaced, facing relation to one another. Participants 55 and 57 stand in one of hoops 14, 16 and 18, 20, respectively, and toss balls 58 towards the basket 32 attached to the opposing framework 12. As more and more balls 58 are made into basket 32, arm 30 pivots downwardly a corresponding amount, thereby opening valve 34 a corresponding amount. The more valve 34 is opened, the more water is emitted from nozzles 54 and 56.

What is claimed is:

1. Game apparatus for use in combination with a water hose and intended to be played by at least two teams, said game apparatus comprising:

a) a framework having a base portion and a water emitting portion extending vertically upward from said base portion, said base portion adapted to operatively receive said hose, said base and water emitting portions being in fluid communication with one another;

b) valve means disposed at an intermediate position within said water emitting portion;

c) an elongated valve actuating member pivotally attached to said water emitting portion, and including a proximal end operatively attached to said valve means and a distal end spaced from said water emitting portion; and d) projectile receiving means operatively attached to said distal end of said valve actuating member.

2. The game apparatus according to claim 1 and further comprising boundary means for positioning adjacent said framework to define the space in which at least one of said at least two teams must stand.

3. The game apparatus according to claim 1 wherein said water emitting portion includes a vertically extending member and a horizontally extending cross member, said vertically extending member having a first end attached in fluid communication with said base portion and a second end to which said cross member is attached, in fluid communication therewith.

4. The game apparatus according to claim 3 wherein said cross member includes first and second ends each having a spray nozzle operatively attached thereto.

5. The game apparatus according to claim 1 wherein said base and water emitting portions are comprised of a plurality of interconnected pipes.

6. The game apparatus according to claim 5 wherein said pipes are composed of polyvinyl chloride.

7. The game apparatus according to claim 1 wherein said valve actuating member is a pipe.

8. The game apparatus according to claim 1 wherein said projectile receiving means is a bucket.

9. The game apparatus according to claim 1 and further comprising projectile means.

10. The game apparatus according to claim 9 wherein said projectile means includes at least one ball.

11. A method for playing a game having game apparatus for use in combination with a hose and intended to be played by at least first and second teams, said method comprising the steps of:

a) positioning said first and second teams in a facing relation to one another and in a predetermined boundary adjacent a water transmitting and emitting framework;

b) tossing a plurality of projectiles towards an opposing valve actuating, projectile receiving member operatively positioned on said water transmitting and receiving framework; and c) repeating step (b) until said valve actuating, projectile receiving member is pivotally moved from its initial, essentially horizontal position to an essentially vertical position.

12. The game apparatus according to claim 11 wherein said valve actuating, projectile receiving member is a pipe having a proximal end operatively attached to a valve disposed within said water transmitting and emitting framework, and a distal end spaced from said framework and having a bucket attached thereto.

13. The game apparatus according to claim 11 wherein said projectiles are balls.

* * * * *